US008196973B2

(12) United States Patent
Craig

(10) Patent No.: US 8,196,973 B2
(45) Date of Patent: Jun. 12, 2012

(54) DEVICE FOR CHILDPROOFING A DOOR LOCK

(76) Inventor: Timothy D. Craig, Corona, CA (US)

( * ) Notice: Subject to any disclaimer, the term of this patent is extended or adjusted under 35 U.S.C. 154(b) by 566 days.

(21) Appl. No.: 12/385,757

(22) Filed: Apr. 17, 2009

(65) Prior Publication Data

US 2009/0266121 A1 Oct. 29, 2009

Related U.S. Application Data

(60) Provisional application No. 61/071,387, filed on Apr. 25, 2008.

(51) Int. Cl.
*E05C 1/08* (2006.01)

(52) U.S. Cl. ..... 292/163; 292/164; 292/336.3

(58) Field of Classification Search ..... 292/163, 292/336.3, 164, 169.14, 359, 352, 351, 348, 292/288; 70/211
See application file for complete search history.

(56) References Cited

U.S. PATENT DOCUMENTS

| | | | | |
|---|---|---|---|---|
| 3,936,086 | A | 2/1976 | Berkowitz | |
| 4,136,898 | A | 1/1979 | Guenther | |
| 4,861,084 | A * | 8/1989 | Ozagir et al. | 292/359 |
| 5,826,924 | A * | 10/1998 | Huang | 292/359 |
| 6,141,998 | A | 11/2000 | Seo | |
| 6,644,077 | B1 * | 11/2003 | Huang | 70/468 |
| 6,868,703 | B2 * | 3/2005 | Molzer | 70/210 |
| 6,929,292 | B1 | 8/2005 | Galindo et al. | |
| 7,004,518 | B2 | 2/2006 | Baser | |
| 7,296,829 | B2 | 11/2007 | Baser | |
| 2004/0079124 | A1 * | 4/2004 | Molzer | 70/210 |
| 2006/0076787 | A1 | 4/2006 | Sundberg et al. | |
| 2006/0170226 | A1 | 8/2006 | Konstantakis et al. | |
| 2006/0208496 | A1 | 9/2006 | Kondratuk et al. | |

FOREIGN PATENT DOCUMENTS

JP 2006-45789 2/2006

* cited by examiner

*Primary Examiner* — Kristina Fulton
(74) *Attorney, Agent, or Firm* — Richard C. Litman

(57) ABSTRACT

The device for childproofing a door lock is a device that fits on a standard lockset and prevents a lever or doorknob from turning when the device is engaged. The childproof door lock includes a substantially rectangular base plate and a circular disk that mounts atop the base. A sliding plate mounted on the base has a cylindrical locking post that engages a notch on the circular disk and prevents it from turning. The sliding plate may be spring-biased to hold the locking post in the notch. A lever may be attached to the sliding plate to disengage the locking post from the notch and allow the circular disk to turn freely.

20 Claims, 3 Drawing Sheets

DEVICE FOR CHILDPROOFING A DOOR LOCK

CROSS-REFERENCE TO RELATED APPLICATION

This application claims the benefit of U.S. Provisional patent application Ser. No. 61/071,387, filed Apr. 25, 2008.

BACKGROUND OF THE INVENTION

1. Field of the Invention

The present invention relates to door locks, and more particularly to a device for childproofing a door lock that fits all types of door locking systems.

2. Description of the Related Art

Child safety locks are typically locks placed on drawers, containers, doors and cabinets for the purpose of preventing children from accessing dangerous material or substances, or from entering dangerous areas. In the United States, law has required child safety locking mechanisms since 1970 on all containers for potentially dangerous medicines and household cleaning products. Child safety locks are also built into some cars to prevent children from opening the doors during transit. Vehicles have included this feature since the early 1980s. While it is locked, the passenger door cannot be opened from the inside. Some vehicles implement window locking mechanisms as well.

While safety locks for doors are not required by law, nevertheless, some parents with small children may wish to secure a door leading to stairways or other potential hazards. Doors generally operate by turning a knob or moving a lever, which removes a latch from a recess in the doorjamb. While most doors, especially doors leading outside, have locks, frequently the locks are unlocked automatically when the doorknob or lever is operated from the interior side of the door. In these types of doors, the only way to prevent a small child from unlocking and opening the door is to prevent the doorknob or lever from turning.

Modern locksets are generally manufactured to fit standard doors used in new buildings. However, there are differences in the configuration of the shafts, and many do not use levers or other handle styles, rather than traditional doorknobs, in order to comply with varied decorating tastes. Additionally, locksets in older homes may not be the same size as modern door hardware. There is a need, therefore, for a child safety lock that fits most locksets. Thus, a device for childproofing a door lock solving the aforementioned problems is desired.

SUMMARY OF THE INVENTION

The device for childproofing a door lock is a device that fits on a standard lockset and prevents a door lever or doorknob from turning when the device is engaged. The childproof door lock includes a rectangular base member that mounts over the shafts of a lockset that extend through a door.

The base member has a central aperture that the central shaft of the lockset extends through. A cylindrical guidepost is mounted on the surface of the base member. The base member has a notch on each side that fits over the side shafts of a lockset. Further, a sliding plate is mounted directly opposite the cylindrical guidepost adjacent the central aperture, and a second cylindrical locking post is mounted on the surface of the sliding plate.

A circular disk with a central aperture is mounted on the base member. The aperture has a keyhole shape that accepts most standard lockset shaft configurations. The circular disk includes an arcuate guide slot that fits over the cylindrical guidepost, and an arcuate locking slot that fits over the cylindrical locking post mounted on the sliding plate. The circular disk turns when the doorknob is turned. The locking slot has a central notch that engages the cylindrical locking post and prevents the circular disk from turning. The sliding plate may be biased with a spring to hold the locking cylinder in the notch, and a lever may be attached to the sliding plate to disengage the post and allow the circular disk to rotate freely.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a device for childproofing a door lock that can be easily adapted to fit a wide variety of locksets.

Figure 1:
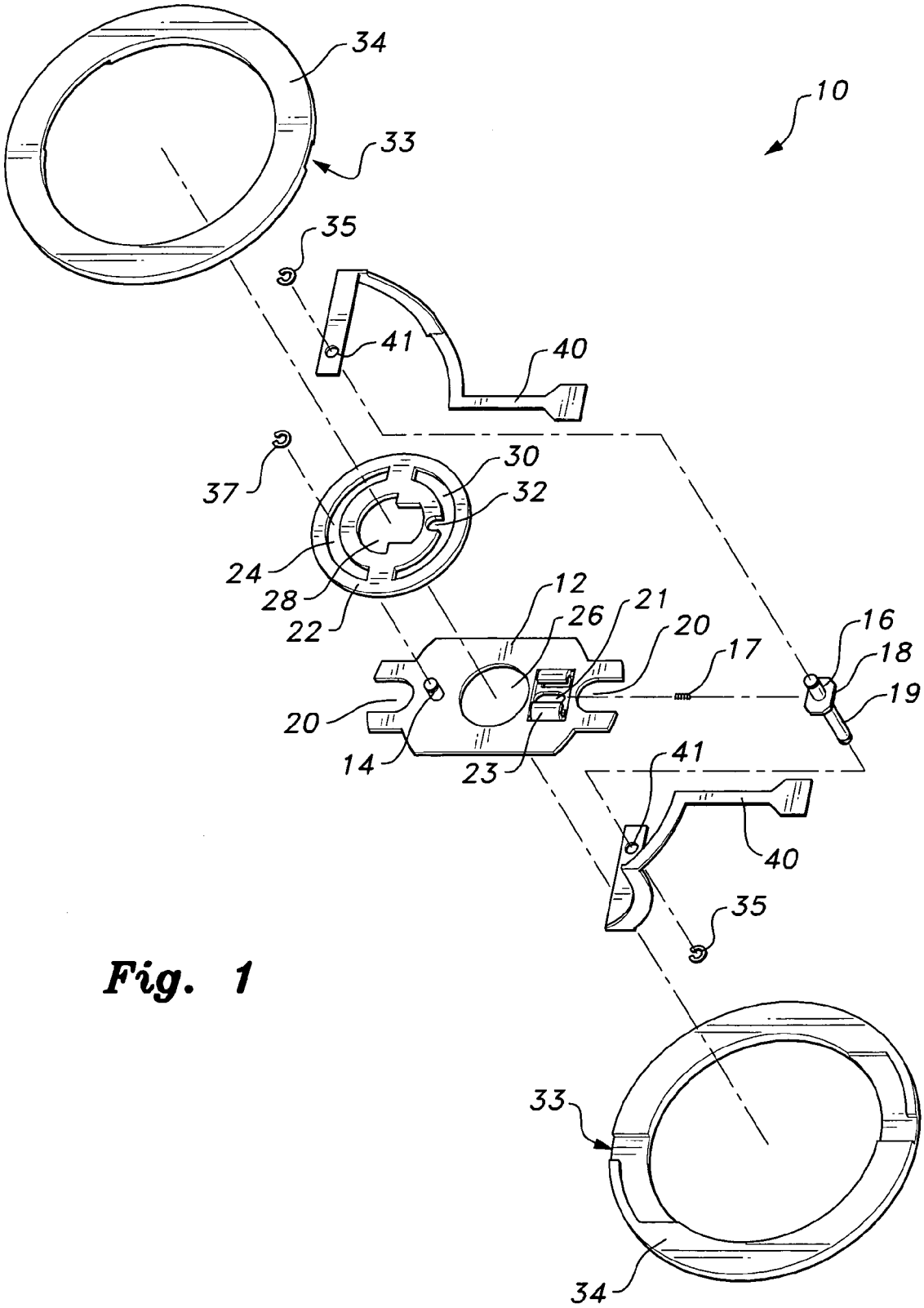
FIG. 1 is an exploded perspective view of a device for childproofing a door lock according to the present invention.

FIG. 1 shows the device for childproofing a door lock, designated generally as 10, in the drawings, having a substantially rectangular base member 12 adapted for mounting on a door lock assembly. The substantially rectangular base member 12 has an aperture 26 formed therethrough that fits over a shaft of a door lock assembly. The rectangular base member 12 further has an integral cylindrical guidepost 14 on its upper surface.

Figure 2:
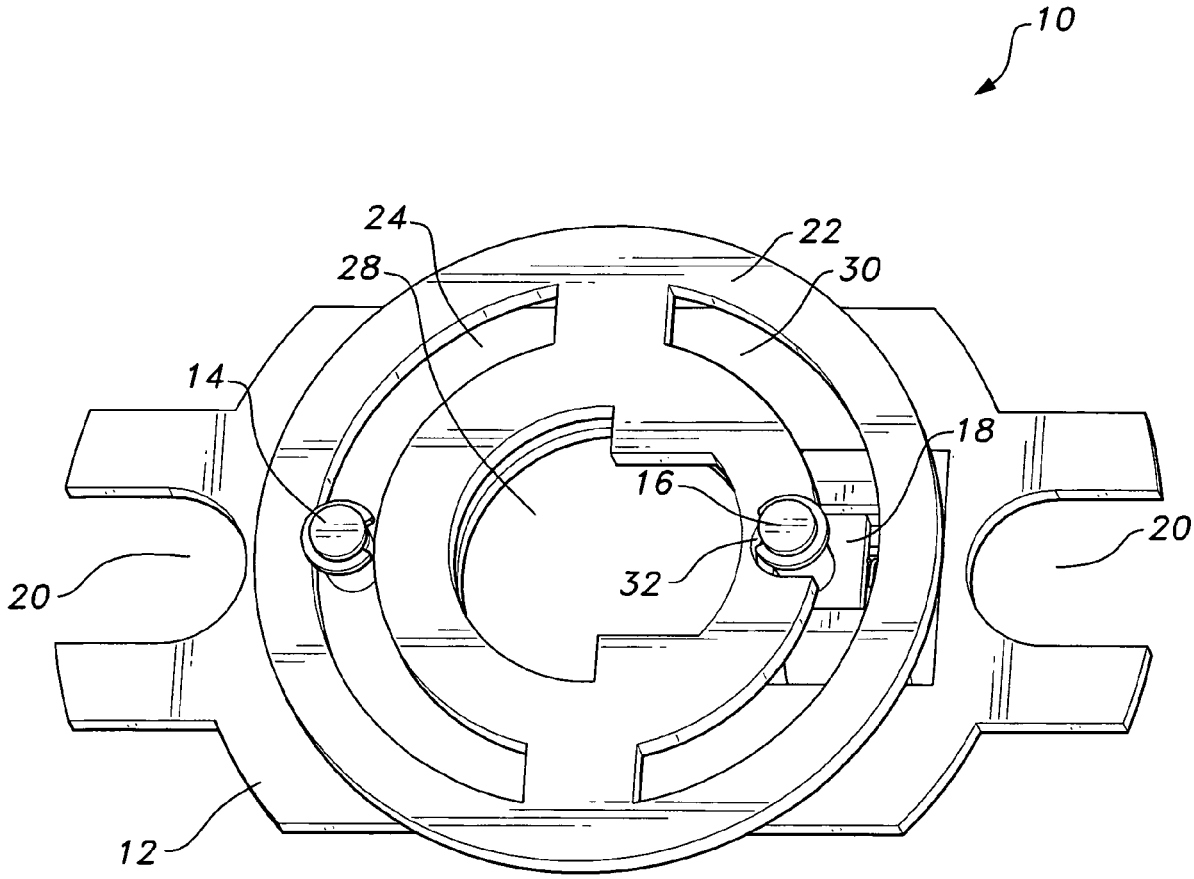
FIG. 2 is a perspective view of a device for childproofing a door lock according to the present invention.

A sliding plate member 18 is positioned adjacent the aperture 26, as shown in the assembled view of FIG. 2. The sliding plate member 18 may be biased with a spring 17. A second cylindrical post 16 is disposed on the upper surface of the sliding plate member 18, and a pin 19 projects downwardly from a lower surface of the sliding plate member 18. The pin extends through a slot 21 defined in the base member 12. The sliding plate member 18 is slidably held adjacent aperture 26 by a pair of retaining brackets 23.

The rectangular base member 12 has laterally opposed, notched sides 20 adapted for mounting over the shafts of a lockset assembly. A circular disk member 22 is rotatably mounted on the rectangular base member 12. The circular disk member has an arcuate guide slot 24. The cylindrical guidepost 14 on the rectangular base member extends through the arcuate guide slot 24.

An arcuate locking slot 30 is disposed opposite the arcuate guide slot 24. The cylindrical locking post 16, which extends from the upper surface of sliding plate member 18, extends through the arcuate slot 30. Snap rings extend into annular grooves formed in guidepost 14 and locking post 16 to retain the posts 14, 16 in their respective slots 24, 30, thereby retaining disk member 22 closely adjacent base member 12. The arcuate locking slot 30 has a notch 32 formed substantially centrally therein to receive the cylindrical locking post 16. The circular disk member 22 also has a central aperture 28 that is keyhole-shaped to fit a variety of lockset shaft configurations.

Figure 3:
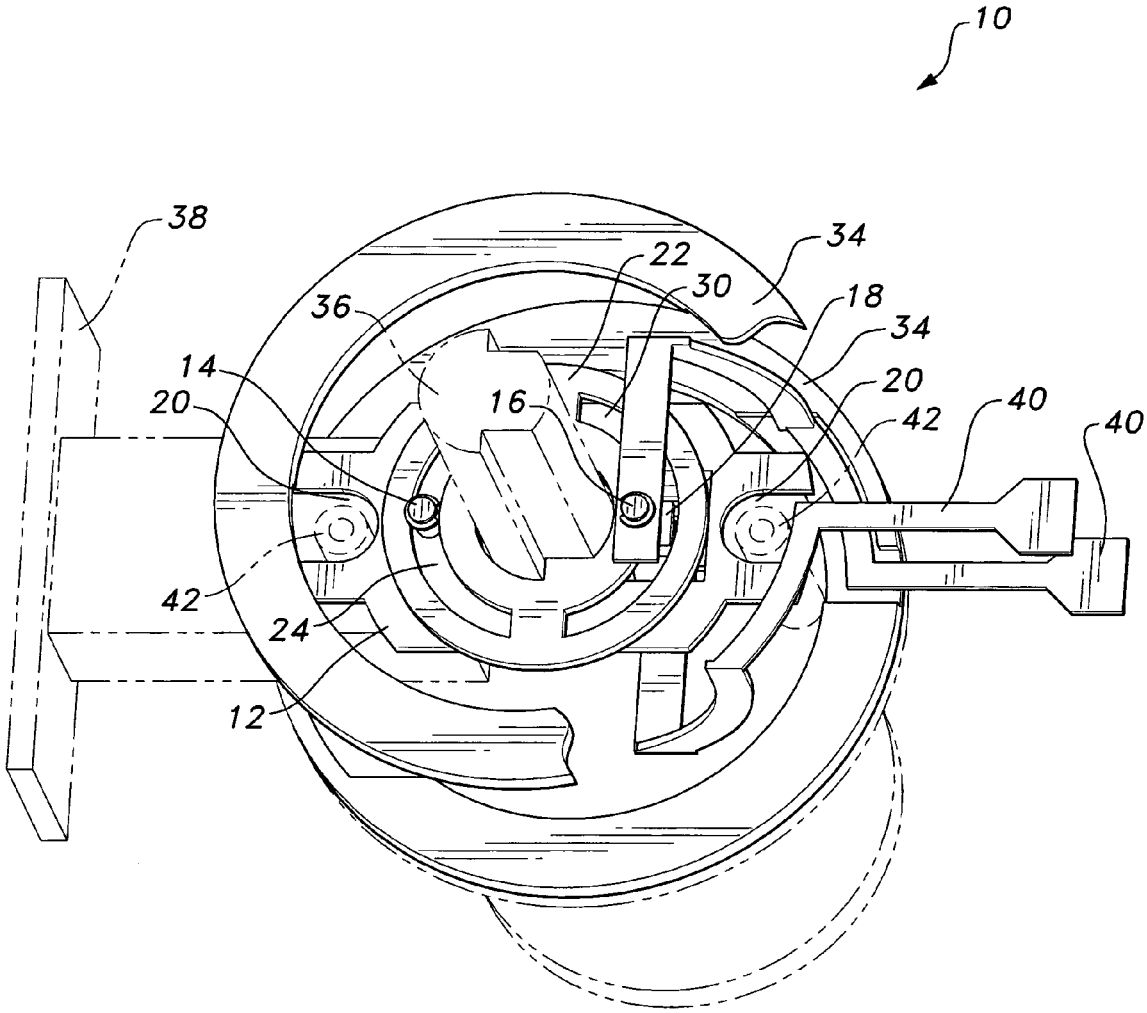
FIG. 3 is an environmental perspective view of a device for childproofing a door lock according to the present invention.

FIG. 2 is a perspective view of the device 10 in the locked position. The cylindrical locking post 16 is shown engaged within the notch 32 in the locking slot 30, thus preventing the cylindrical disk member 22 from rotating with respect to the base 12. FIG. 3 illustrates the device 10 mounted on a door lock assembly. The door lock assembly includes a central shaft 36, shown in phantom, that extends through the aperture 26 of the rectangular base member 12, and through the aperture 28 of the circular disk member 22. FIG. 3 shows the notched sides 20 of the rectangular base member 12 mounted over the side shafts 42 (shown in phantom) of the door lock assembly. A spacer 34 fits between the doorknob and the door, and has a notch 33 formed on a lower surface thereof, seen most clearly in FIG. 1, to fit a sliding release lever 40. In FIG. 3, the childproof safety lock is shown in the locked position, with the locking post 16 engaging the notch 32 of the circular disk member 22.

Preferably, a pair of spacers 34 are provided, each having respective notches 33 for retaining and receiving a pair of release levers 40. As best shown in FIG. 1, each release lever 40 has an opening 41 formed through a fixed end thereof, with one of the release levers 40 receiving the second cylindrical post 16 through its opening 41, and the other release lever 40 being mounted on the opposite side of plate 12, with pin 19 extending through its opening 41. The release levers 40 are held to cylindrical post 16 and pin 19, respectively, by snap rings 35. Similarly, cylindrical post 14 is held within arcuate slot 24 by a snap ring 37.

In use, the user must grip the free ends of release levers 40 in order to pull the sliding plate 18 along the lateral direction in order to disengage the second cylindrical post 16 from notch 32, thus allowing the post 16 to freely rotate within arcuate slot 30, permitting disk 22 and lock assembly central shaft 36 to rotate over the arc defined by slot 30.

It is to be understood that the present invention is not limited to the embodiment described above, but encompasses any and all embodiments within the scope of the following claims.

I claim:

1. A device for childproofing a door lock assembly, wherein the door lock assembly includes a central shaft and a pair of side shafts, comprising:

a substantially rectangular base member having an upper surface, a central aperture formed therethrough and a pair of notched sides adapted for mounting on the side shafts of a door lock assembly;

a first cylindrical post extending from the upper surface of the base member;

a sliding plate member slidably mounted on the base member, the sliding plate member having an upper surface and a lower surface;

a second cylindrical post extending from the upper surface of the sliding plate member;

a circular disk member rotatably mounted on the upper surface of the base member, the disk member having a central aperture formed therethrough and being dimensioned to receive the central shaft of the door lock assembly, an arcuate guide channel and an arcuate locking channel opposite the guide channel, the first cylindrical post extending through and being slidable in the arcuate guide channel, the second cylindrical post extending through and being slidable in the locking channel, the locking channel having a central notch for releasably receiving the second cylindrical post to limit slidable movement in the locking channel and prevent complete rotation of the central shaft of the door lock assembly; and means for selectively disengaging the second cylindrical post from the central notch to allow unlimited slidable movement in the locking channel to permit complete rotation of the central shaft of the door lock assembly to open the door.

2. The device for childproofing a door lock as recited in claim 1, wherein the central aperture formed through the substantially rectangular base member is substantially circular.

3. The device for childproofing a door lock as recited in claim 1, wherein said substantially rectangular base member has a slot formed therein adjacent the central aperture, the slot being positioned diametrically opposite said first cylindrical post with respect to the central aperture.

4. The device for childproofing a door lock as recited in claim 3, further comprising a pin extending from the lower surface of said sliding plate member, the pin being slidably in the slot defined in said base member.

5. The device for childproofing a door lock as recited in claim 4, further comprising at least one bracket mounted on the upper surface of said base member, the at least one bracket slidably retaining said sliding plate member to said base member.

6. The device for childproofing a door lock as recited in claim 5, wherein said sliding plate member is spring-biased on said base member.

7. The device for childproofing a door lock as recited in claim 6, wherein the central aperture of said circular disk member is substantially keyhole-shaped.

8. The device for childproofing a door lock as recited in claim 7, wherein the arcuate guide channel and the arcuate locking channel each are substantially semicircular.

9. The device for childproofing a door lock as recited in claim 8, wherein the arcuate guide channel and the arcuate locking channel are diametrically opposed on opposite sides of the central aperture formed through the circular disk member.

10. The device for childproofing a door lock as recited in claim 9, further comprising means for slidably securing the first cylindrical post within the arcuate guide channel.

11. The device for childproofing a door lock as recited in claim 9, further comprising a first release lever having opposed fixed and free ends, the fixed end thereof being pivotally attached to the second cylindrical post, whereby the user may grip the free end thereof and slide the first release lever to selectively disengage the second cylindrical post from the central notch.

12. The device for childproofing a door lock as recited in claim 11, further comprising a second release lever having opposed fixed and free ends, the fixed end thereof being pivotally attached to the pin.

13. The device for childproofing a door lock as recited in claim 12, further comprising means for respectively securing the first and second release levers on the second cylindrical post and the pin.

14. A device for childproofing a door lock assembly, wherein the door lock assembly includes a central shaft and a pair of side shafts, comprising:

a substantially rectangular base member having a central aperture formed therethrough, an upper surface, and a pair of notched sides adapted for mounting on the side shafts of a door lock assembly;

a first cylindrical post extending from the upper surface of the base member;

a sliding plate member slidably mounted on the base member, the sliding plate member having an upper surface;

a second cylindrical post extending from the upper surface of the sliding plate member;

a circular disk member rotatably mounted on the upper surface of the substantially rectangular base member, the disk member having a central aperture formed therethrough and being dimensioned to receive the central shaft of the door lock assembly, an arcuate guide channel, and an arcuate locking channel formed therethrough, the first cylindrical post being slidable in the arcuate guide channel, the second cylindrical post being slidable in the locking channel, the locking channel having a central notch for releasably receiving the second cylindrical post to limit slidable movement in the locking channel and prevent complete rotation of the central shaft of the door lock assembly; and a first release lever having opposed fixed and free ends, the fixed end thereof pivotally attached to the second cylindrical post, whereby the user may grip the free end thereof and slide the first release lever to selectively disengage the second cylindrical post from the central notch.

15. The device for childproofing a door lock as recited in claim 14, wherein the base member has a slot defined therein adjacent the central aperture, the slot being positioned diametrically opposite the first cylindrical post.

16. The device for childproofing a door lock as recited in claim 15, further comprising a pin extending from the lower surface of said sliding plate member, the pin being slidable in the slot defined in the base member.

17. The device for childproofing a door lock as recited in claim 16, further comprising a second release lever having opposed fixed and free ends, the fixed end being pivotally attached to the pin.

18. The device for childproofing a door lock as recited in claim 17, further comprising means for respectively attaching the first and second release levers to the second cylindrical post and the pin, respectively.

19. The device for childproofing a door lock as recited in claim 18, wherein said sliding plate member is spring-biased with respect to substantially rectangular base member.

20. The device for childproofing a door lock as recited in claim 19, wherein the arcuate guide channel and the arcuate locking channel are each substantially semicircular.

* * * * *